United States Patent [19]

Zago

[11] 4,354,093

[45] Oct. 12, 1982

[54] ELECTRICALLY HEATED HAIR CURLING INSTRUMENT AND TEMPERATURE CONTROL STAND THEREFORE

[76] Inventor: Jean-Claude Zago, 6286 Belleau St., Montreal, Quebec, Canada, H1P 1H6

[21] Appl. No.: 151,279

[22] Filed: May 19, 1980

[51] Int. Cl.[3] ..... H05B 1/02; A45D 1/04; A45D 2/36

[52] U.S. Cl. ..... 219/225; 132/11 R; 132/31 R; 132/37 R; 219/241; 219/242; 219/533

[58] Field of Search ..... 219/222–226, 219/240–242, 533; 132/31 R, 32 R, 37 A, 37 R, 11 R, 9

[56] References Cited

U.S. PATENT DOCUMENTS

| | | | |
|---|---|---|---|
| 1,540,564 | 6/1925 | Olson | 132/37 |
| 1,618,306 | 2/1927 | Pedersen | 132/37 |
| 1,622,834 | 3/1927 | Marcel | 132/37 |
| 2,228,571 | 1/1941 | Kuhn et al. | 219/242 |
| 2,248,486 | 7/1941 | Birk | 219/242 |
| 2,717,952 | 9/1955 | Dvorak | 219/241 X |
| 3,534,392 | 10/1970 | Trouilhet | 219/225 |
| 3,551,639 | 12/1970 | Gotley | 219/241 |
| 3,646,577 | 2/1972 | Ermst | 219/241 |
| 3,716,692 | 2/1973 | Schick et al. | 219/241 |
| 3,859,497 | 1/1975 | McNair | 219/225 |
| 3,892,943 | 7/1975 | Van Droogenbroek | 219/222 |
| 3,934,114 | 1/1976 | Godel et al. | 219/222 |
| 3,946,196 | 3/1976 | Waters et al. | 219/222 |
| 3,955,064 | 5/1976 | Demetrio et al. | 219/225 |
| 4,024,375 | 5/1977 | Olesen et al. | 219/225 |
| 4,029,110 | 6/1977 | Hyland | 219/225 X |

FOREIGN PATENT DOCUMENTS

| | | | |
|---|---|---|---|
| 2506074 | 2/1975 | Fed. Rep. of Germany | 219/222 |
| 1309254 | 3/1973 | United Kingdom | 219/241 |
| 1507033 | 4/1978 | United Kingdom | 219/241 |

*Primary Examiner*—A. Bartis

[57] ABSTRACT

An electrically heated hair curling instrument, such as a curling iron, includes heating element having an outer tube enclosing a thermistor located between a pair of longitudinally spaced electric heating coils and arranged in contact with the tube interior surface. The heating element is detachably connected to the end of a handle assembly by mating electrical connectors. An electric cord connects the heating coils and thermistor through the mating connectors and a rotatable mandrel and slip rings in the handle assembly to a temperature control box mounted in a stand having means for supporting the curling instrument when not in use. A manually-adjustable temperature control circuit located in the control box and responsive to the temperature of the heating element as measured by the thermistor controls energization of the curling instrument, depending on the type of hair being curled. The stand and control box can be arranged to accomodate and control two curling instruments of different size.

6 Claims, 11 Drawing Figures

18
42
102
52
36
14
SW2
SW1
42
102
12
20
52
24
14
36
18
26
10
12
22

42
42
3
52
52
18
22
18
24
36
36
4
SW1
SW2
PL2
12
PL1
26
12
10
3
4

ELECTRICALLY HEATED HAIR CURLING INSTRUMENT AND TEMPERATURE CONTROL STAND THEREFORE

This invention relates to a hair curling instrument.

Various types of hair curling instruments are known. However, the main drawback of known instruments is that none of them is equipped with a temperature control which can be varied, depending on the type of hair being curled and, furthermore, can be accurately maintained at a set temperature.

It is therefore the object of the present invention to provide a hair curling instrument which is equipped with a temperature control circuit permitting variation of the temperature of the curling iron at will within a set range.

It is a further object of the present invention to provide a curling iron which is well designed, safe in operation and best suited for commercial use by professional hairdressers.

The hair curling instrument in accordance with the present invention comprises an electrically-operated curling iron, a stand having means for supporting the curling iron when not in use, a temperature control box mounted in the stand, an electric cord for carrying electric power from the control box to the curling iron, and a control circuit located in the control box and responsive to the temperature of the curling iron for controlling de-energization of the curling iron, depending on the type of hair being curled.

The curling iron comprises a handle assembly, a detachable heating element mounted on the end of the handle assembly and a hair clamping means pivotally mounted on the handle assembly.

As a further characteristic of the invention, the handle assembly comprises a handle, a mandrel rotatably mounted within the handle, a plurality of slip rings secured to one end of the mandrel, means for connecting each wire of the electric cord to one of the slip rings, an electric connector secured to the outer end of the mandrel, and means for electrically connecting each of the slip rings to one socket of such connector. The electric cord is also preferably provided with a ground wire, which is connected through one of the slip rings to the handle assembly for grounding such handle assembly.

The heating element preferably comprises a hollow mandrel, two heating coils electrically connected in series and longitudinally mounted on the hollow mandrel, an outer heat-conducting tube covering such coils and closing one end of the heating element, a thermistor mounted between the heating coils and contacting the inside of the heat-conducting tube for measuring the temperature of such tube, a connector secured to the outer end of the heating element, and means for interconnecting the heating coils and the thermistor to such last-mentioned connector. A thermo-switch is preferably located within the mandrel of the heating element and connected in series with the heated coils for de-energizing the heating coils when the temperature of the heating element exceeds a predetermined value.

The control circuit preferably comprises a triac connected in series with the heating coils and a zero-voltage switch responsive to such thermistor for controlling de-energization of the triac. Such control circuit preferably includes a first variable potentiometer for controlling the setting of such zero-voltage switch within a predetermined range well suited to curling of various types of hair and a second variable potentiometer for calibrating such zero-voltage switch so as to set the minimum operating temperature of the curling iron.

The control box and stand can preferably accommodate two curling irons of different size, depending on how tight the hairdresser wishes to curl the hair of his client. Each iron is equipped with its own temperature control circuit, but with a common first variable potentiometer controlling the setting of temperature of the two curling irons.

The invention will now be disclosed by way of example with reference to the accompanying drawings, in which.

Figure 1:
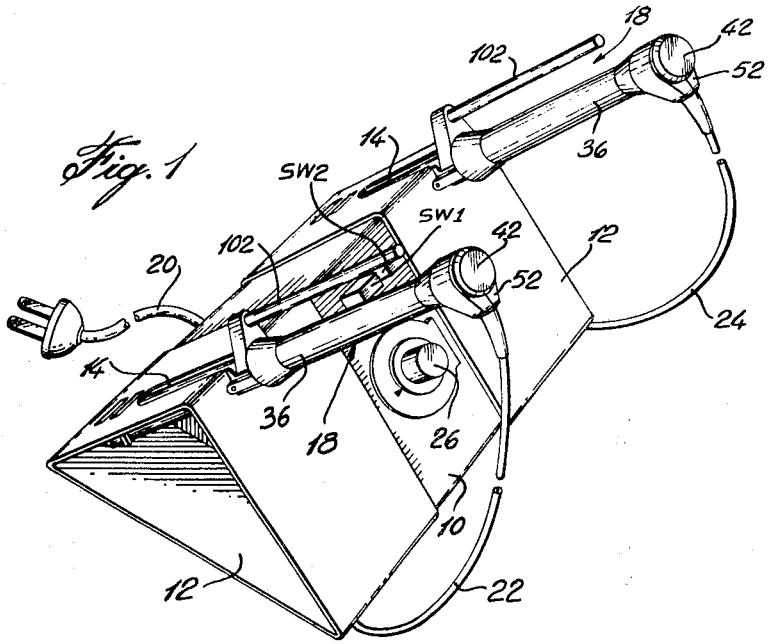
FIG. 1 illustrates a perspective view of a hair curling instrument in accordance with the invention.
Figure 2:
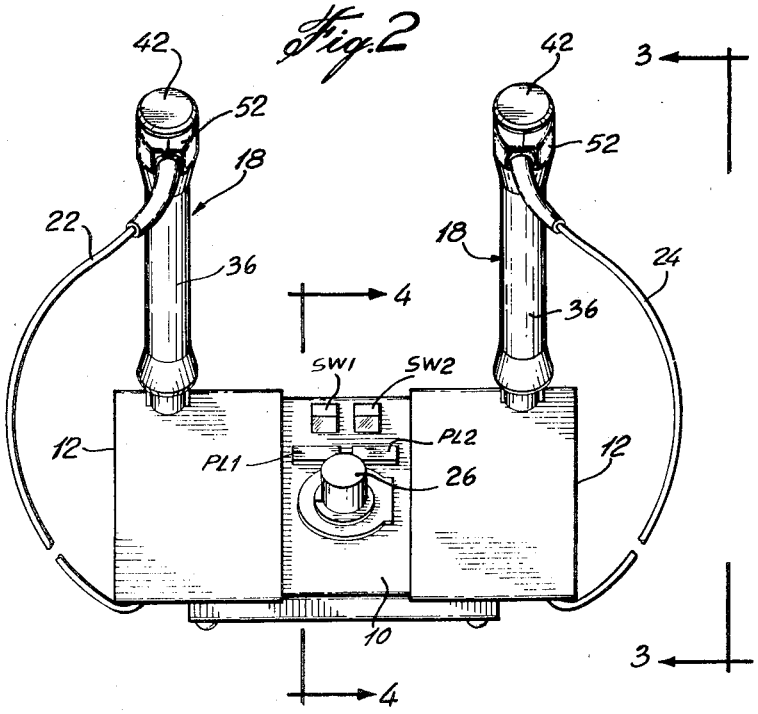
FIG. 2 illustrates a front view of the hair curling instrument shown in FIG. 1.
Figure 3:
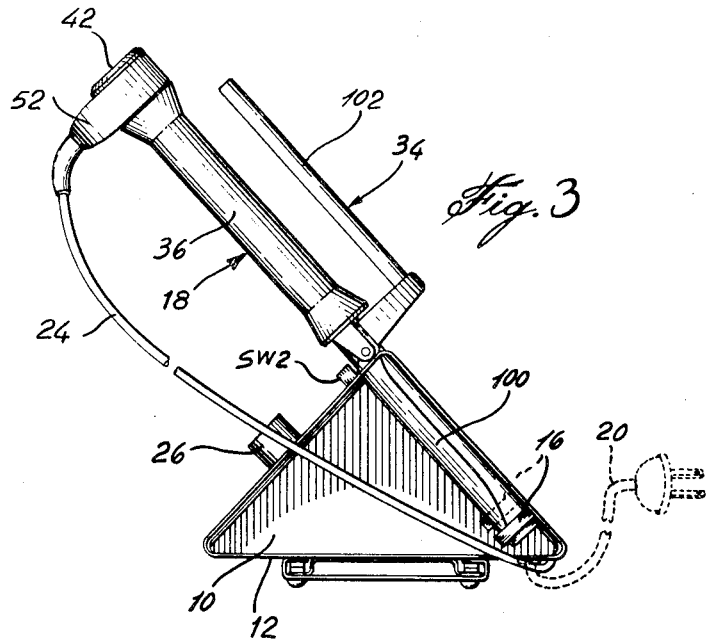
FIG. 3 illustrates a view taken along line 3—3 of FIG. 2.
Figure 4:
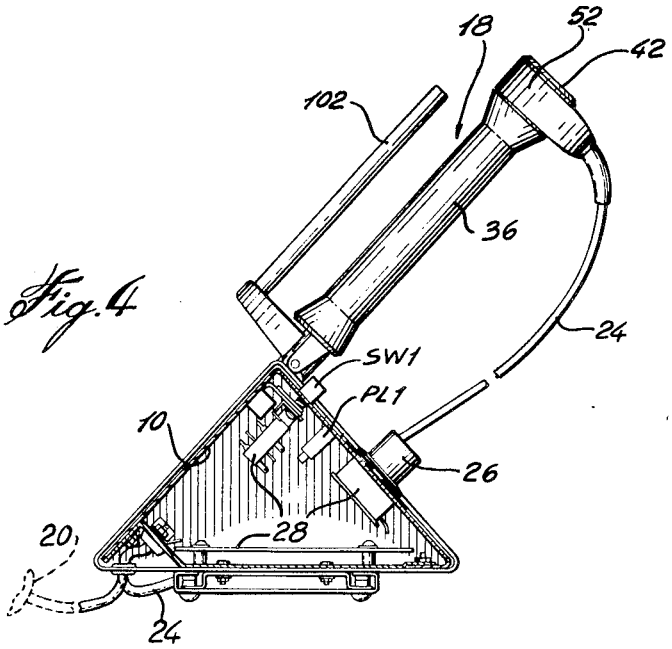
FIG. 4 illustrates a view taken along line 4—4 of FIG. 2.

Referring to FIGS. 1 to 4, there is shown a control box 10 provided at each end with a stand 12 having an elongated recess 14 and clips 16 for holding a curling iron 18. The electric power is fed to the stand by means of an electric cord 20, which is adapted for connection to a 110-v.a.c. outlet. The curling irons are connected to the control box by means of separate electric cords 22 and 24 and, as it will be seen later, the electric irons can be selectively energized by means of switches SW1 or SW2.

Pilot lights PL1 and PL2 indicate which one of the irons is energized. The temperature of both irons can be adjusted by means of a control knob 26, which is part of a control circuit, to be disclosed later, and which includes various electrical components 28 located within the control box.

Figure 5:
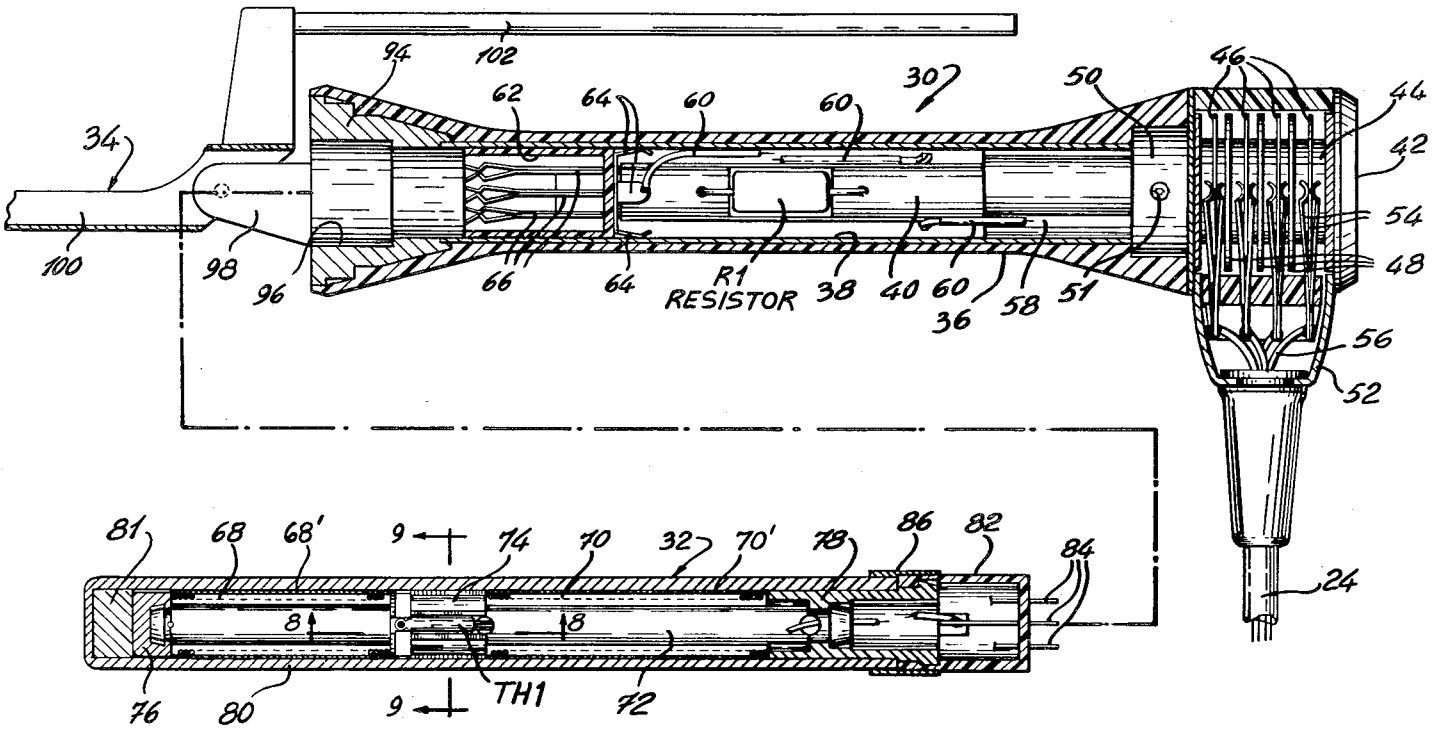
FIG. 5 illustrates in longitudinal section an enlarged view of the hair curling iron.
Figure 6:
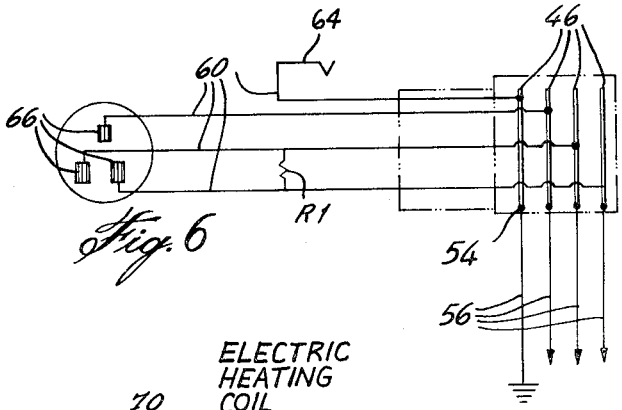
FIG. 6 illustrates a schematic diagram of the electrical circuit of the handle assembly part of the curling iron.

Referring more particularly to FIG. 5, the curling iron comprises a handle assembly 30, a detachable heating element 32 and a hair clamping means 34. The handle assembly comprises a heat-insulating handle 36 rotatably mounted on an inner metallic grounding sleeve 38 and, within the metallic sleeve 38, a central mandrel 40 having an end cap 42 upon which is mounted a bushing 44 carrying a plurality of slip rings 46 separated by insulating spacers 48. The metallic sleeve 38 and the bushing 44 are secured to the mandrel 40 by a collar 50 provided with a tightening screw 51. The bushing 44 is covered by a split casing 52 containing a plurality of pairs of contactors 54, each pair being adapted to engage a slip ring 46 for transmitting power from the individual wires 56 of cords 22 or 24 to their respective rings. The mandrel 40 is provided with a plurality of longitudinal grooves 58 housing individual wires 60 which are connected at one end to the slip rings, and at the other end to a female connector 62, which is secured to the opposite end of mandrel 40. As shown in FIG. 6, one of the incoming wires 60 is a ground wire which is connected to metallic sleeve 38 through sliding contacts 64 for grounding the curling iron and protecting the user from electric shock. The remaining three wires are connected to individual sockets 66 of the female connector. A resisor R1 is also mounted on the mandrel and connected between two other wires 60 for a purpose to be disclosed later.

The heating element 32 comprises two heating coils 68 and 70, which are mounted on a hollow mandrel 72 provided with a central portion 74 longitudinally spacing the two coils and two end caps 76 and 78. The heating coils 68 and 70 surrounded by metallic protective sleeves 68' and 70' and by a heat-conducting tube 80, the inside of which engages the central portion 74 of the mandrel 72 and the end cap 78. End cap 76 engages a heat-conducting pad 81 at the closed end of the tube 80. A male connector 82 is secured to the end cap 78 and provided with prongs 84 adapted to engage the sockets 66 of female connector 62. A bushing 86 is provided over the connector 82 for a purpose to be disclosed later.

Figure 7:
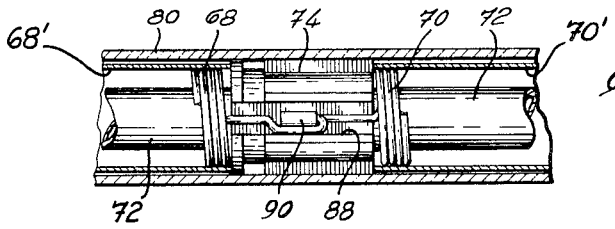
FIG. 7 illustrates a partial longitudinal sectional view of the heating element of FIG. 5 taken on the outside of the heating coils.
Figure 8:
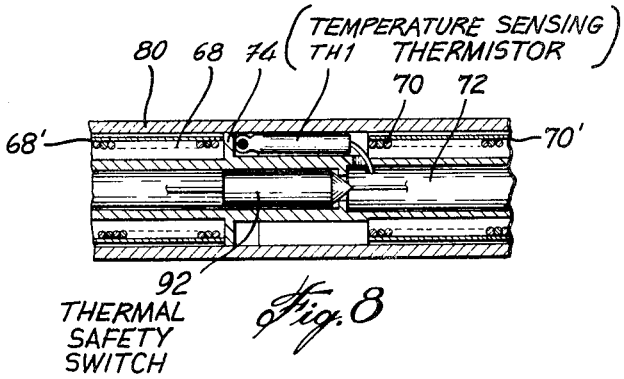
FIG. 8 illustrates a partial longitudinal sectional view taken along line 8—8 of FIG. 5.
Figure 9:
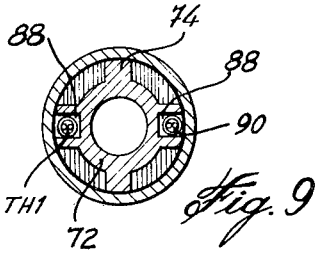
FIG. 9 illustrates a view taken along line 9—9 of FIG. 5 wherein the thermal switch, shown in FIG. 8, is omitted for clarity.
Figure 10:
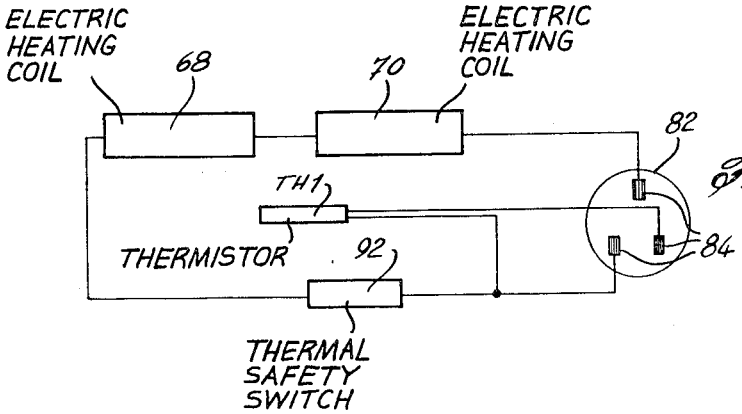
FIG. 10 illustrates a schematic diagram of the electrical circuit of the heating element.

As shown in FIGS. 7 to 9, the central portion 74 of the mandrel 72 is provided with slots 88, one of which for lodging a connector 90 for connecting the two heating coils in series. A thermistor TH1 is also mounted in one of the slots in the central portion 74 of the mandrel 72 adjacent the inside surface of the heat-conducting tube 80 for detecting the temperature of the iron. A thermal cut-off switch 92 is located inside the mandrel. The various components of the heating elements are interconnected, as indicated in FIG. 10 of the drawings. The two coils 68 and 70 are connected in series with the thermal cut-off switch 92 across two of the prongs of the male connector 82. Switch 92 is for cutting off the power to the curling iron when the temperature exceeds a predetermined value in case of malfunction of the control circuit. The thermistor TH1 is connected across two prongs of the female connector for controlling the temperature of the iron, as it will be seen later.

Returning to FIG. 5 of the drawings, the heating element is detachably inserted into a coupling member 94, which is secured to the end of metallic sleeve 38. Coupling member 94 has an opening 96, of the same diameter as bushing 86, to permit insertion of the heating element into the handle assembly.

It will be noted that heating elements of various diameters are needed, depending upon how tight the hairdresser wishes to curl the hair of his client. The outside diameter of the bushing 86 of each heating element is designed such as to fit into opening 96 of the coupling member 94 of the handle assembly, so as to permit the use of the same handle assembly for several heating elements. The coupling member 94 is also provided with a pair of brackets 98 for pivotally mounting a conventional hair-clamping jaw 100 having an operating handle 102.

Figure 11:
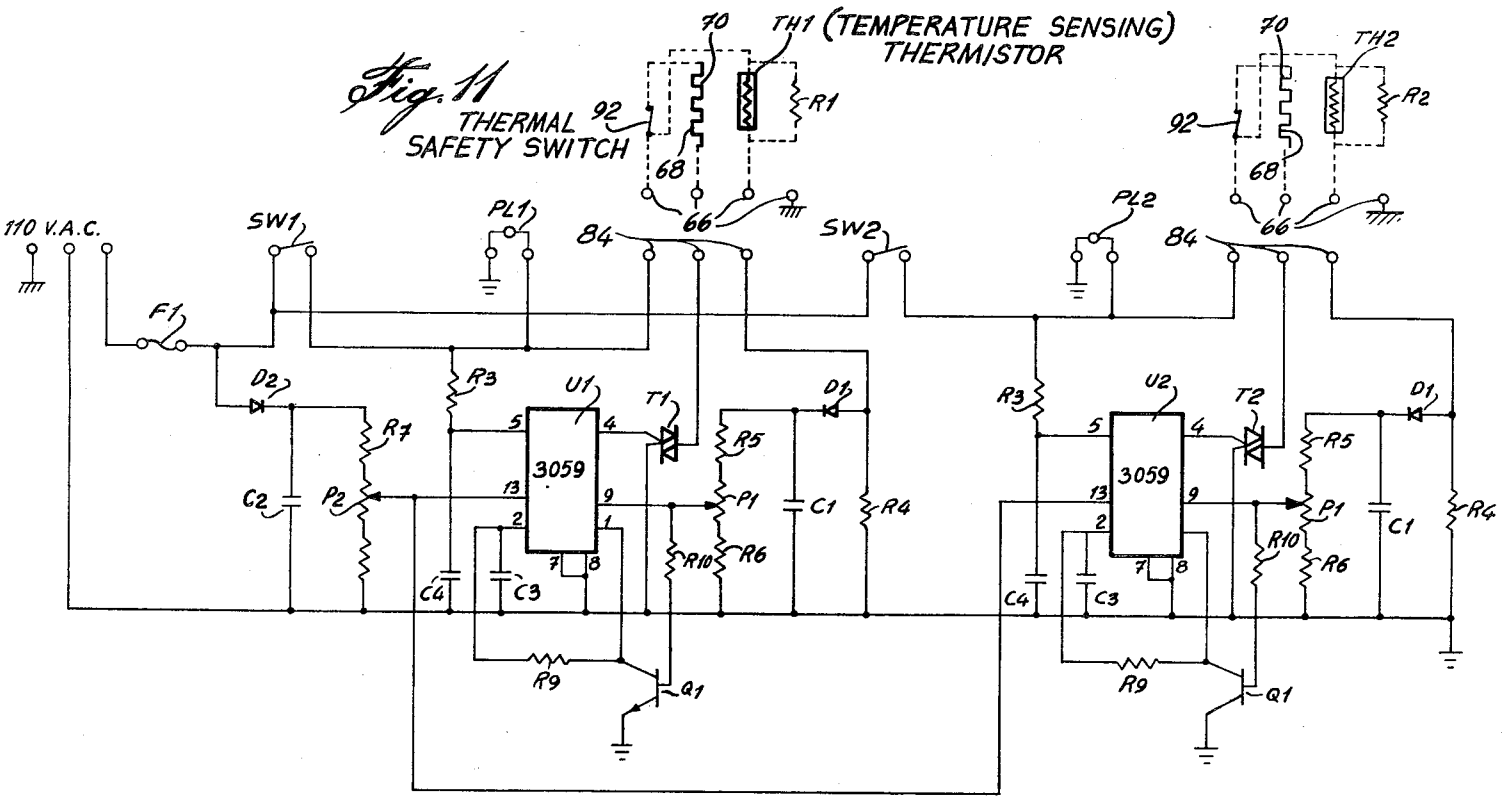
FIG. 11 illustrates a schematic diagram of the control circuit of the hair curling instrument in accordance with the invention.

FIG. 11 of the drawings illustrates a schematic diagram of the electrical circuit for controlling the temperature of the curling irons. Electrical power is applied to the heating coils 68 and 70 of each iron through manual switches SW1 or SW2, connector elements 66 and 84, thermal cut-off switch 92 and triac T1 or T2. The electric circuit is protected by a fuse F1 in known manner. Pilot lights PL1 and PL2 indicate which one of the curling irons is being connected to the source of power. The control circuit of triacs T1 and T2 are identical and the one associated with triac T1 only will be described. Therefore, circuit elements associated with the control of triac T2 will be identified by the same reference numerals, but not further disclosed.

The conduction of triac T1 is controlled by a conventional zero-voltage switch U1, such as the one identified by serial number CA3059 and sold by RCA. The description of such circuit is given in a RCA manual entitled: "LINEAR INTEGRATED CIRCUITS" 1973—pages 380–388. Zero-voltage switch CA3059 is a monolithic silicon integrated circuit designed to control a triac and comprises generally:

(1) a limiter-power supply permitting operation directly from the AC line through external series resistor R3 connected to pin 5 of the integrated circuit;
(2) a triac gating circuit which provides at pin 4 high current pulses to the gate of triac to control conduction thereof;
(3) a zero crossing detector which synchronizes the output pulses of the gate circuit at the time when the AC cycle is at zero voltage, thereby eliminating radio-frequency interference;
(4) a differential on/off sensing amplifier for sensing the conditions of an external sensor through pins 9 and 13 and controlling a conduction of the triac gating circuit accordingly.

In the circuit of the present invention, thermistor TH1 is connected across the 110-v.a.c. source through a parallel circuit including, in one branch, a resistor R4 and, in a second branch, diode D1, resistor R5, potentiometer P1 and resistor R6. A capacitor C1 is also connected across resistor R5, potentiometer P1 and resistor R6 for filtering the DC voltage developed across the resistor R5, potentiometer P1 and resistor R6. The voltage developed across the variable tap of the potentiometer P1 is applied to pin 9 of the zero-voltage switch. Potentiometer P1 permits calibration of the temperature control circuit at a minimum temperature value of, say, 140° C. 110-v.a.c. is applied to a DC rectifying circuit including diode D2, resistor R7, potentiometer P2 and resistor R8. The voltage across resistor R7, potentiometer P2 and resistor R8 is filtered by capacitor C2. The variable tap of potentiometer P2 is applied to pin 13 of both zero-voltage switches U1 and U2 and such voltage is adjusted, by the relative value of resistors R7 and R8 and the setting of the variable potentiometer P2 to vary the input voltage applied to pin 13 in such a way as to control the temperature of both curling irons over a desired range of, say, 140° C. to 185° C. Pin 7 is the ground terminal of the zero-voltage switch and pin 8 the ground terminal of the differential sensing amplifier.

An external inhibit circuit is connected to pin 1 of the zero-voltage switch to remove drive from the triac in case the thermistor fails. Such inhibit circuit includes transistor Q1 which is powered from pin 2 of the zero-voltage switch through a resistor R9. Resistor R1, located in the handle assembly of the curling iron, ensures the circuit continuity in case the thermistor burns out.

The base of the transistor is controlled from the potential appearing at the variable tap of the potentiometer P1 through resistor R10, so that the transistor is conducting under normal operation of the curling iron and provides a logical 0 at the output of pin 1. However, if the thermistor burns out, transistor Q1 will become non-conductive and provide a logical 1 at pin 1 to inhibit operation of the triac. External capacitors C3 and C4 are connected to pins 2 and 5, respectively, for filtering purposes.

The above-disclosed circuit thus permits to set the curling iron in a temperature within a predetermined range by turning control knob 26, which is coupled to potentiometer P2. The minimum temperature is normally set at the factory, but may be re-adjusted, if needed by varying potentiometer P1 associated with each curling iron and located in the control box of the stand. This way, the hairdresser may set the temperature of his curling iron, depending on the type of hair being curled. The zero-voltage switch is a very accurate device and maintains the temperature of the iron at less than plus or minus 5° C., generally about 2° C.

Although the invention has been disclosed with reference to a preferred embodiment, it is to be understood that the invention is not limited to such embodiment and that other alternatives are also envisaged.

What I claim is:

1. A hair curling instrument comprising:

(a) an electrically-operated curling iron;

(b) a stand having means for supporting said curling iron when not in use;

(c) a temperature control box mounted on said stand;

(d) an electric cord for carrying electric power from the control box to the curling iron;

(e) said curling iron comprising a handle assembly, a detachable heating element mounted on the end of said handle assembly and a hair-clamping means pivotally mounted on said handle assembly;

(f) said handle assembly comprising a handle, a mandrel rotatably mounted within said handle, a plurality of slip rings secured to one end of said mandrel, means for connecting each wire of said electric cord to a different one of said rings, a first electrical connector member having a plurality of terminals secured to the other end of said mandrel, and means for electrically interconnecting each of said slip rings to a different terminal of said first connector member;

(g) said heating element comprising an open-ended hollow mandrel, two longitudinally-spaced heating coils electrically connected in series and mounted on said hollow mandrel, an outer heat-conducting tube covering said coils and having a closed end, a thermistor mounted on said mandrel between said heating coils and contacting the inside of said heat-conducting tube for measuring the temperature of said tube, a second electrical connector member having a plurality of terminals corresponding to the terminals of said first connector member and secured to the other end of said outer tube means for interconnecting said heating coils and said thermistor to different terminals of said second connector member, said second connector member having its terminals removably coupled to the corresponding terminals of said first connector member carried by said handle assembly;

(h) and a manually-adjustable temperature control circuit located in said control box, connected to said thermistor through wires of said power cord, said slip rings and first and second connector members and responsive to the temperature of the curling iron as measured by said thermistor for controlling the de-energization of the curling iron, depending on the type of hair being curled.

2. A curling instrument as defined in claim 1, further comprising a thermal switch located within said mandrel and connected in series with said heating coils for de-energization said heating coils when the temperature of said heating element exceeds a predetermined value.

3. A curling instrument as defined in claim 1, wherein said control circuit compriss a triac connected in series with said heating coils through said power chord, slip rings and first and second connector members, and a zero-voltage switch responsive to said thermistor for controlling de-energization of said triac.

4. A curling instrument as defined in claim 3, wherein said control circuit includes a first variable potentiometer for controlling the setting of said zero-voltage switch and a second variable potentiometer for calibrating said zero-voltage switch, so as to set the minimum operating temperature of the curling iron.

5. A curling instrument as defined in claim 3, wherein said control box and stand can accommodate two such curling irons of different size, each iron being equipped with its own such temperature control circuit, but with a common variable potentiometer controlling the setting of the zero-voltage switch of both temperature control circuits and, thus, the temperature of both curling irons.

6. A curling instrument as defined in claim 1, wherein said handle has an internal grounding sleeve and wherein said electric cord further comprises a ground wire which is connected to one of said slip rings and to said grounding sleeve for grounding the handle.

* * * * *